US006536451B2

(12) United States Patent
Hechtl et al.

(10) Patent No.: US 6,536,451 B2
(45) Date of Patent: Mar. 25, 2003

(54) DISHWASHER

(75) Inventors: Georg Hechtl, New Bern, NC (US); Hans-Peter Nannt, Gerstetten (DE); Peter Huber, Setzingen (DE)

(73) Assignee: BSH Bosch und Siemens Hausgerate GmbH, Munich (DE)

( * ) Notice: Subject to any disclaimer, the term of this patent is extended or adjusted under 35 U.S.C. 154(b) by 0 days.

(21) Appl. No.: 10/053,982

(22) Filed: Jan. 22, 2002

(65) Prior Publication Data

US 2002/0117194 A1 Aug. 29, 2002

Related U.S. Application Data

(63) Continuation of application No. PCT/EP00/06348, filed on Jul. 5, 2000.

(30) Foreign Application Priority Data

Jul. 19, 1999 (DE) ..... 199 33 700

(51) Int. Cl.[7] ..... A47L 15/42
(52) U.S. Cl. ..... 134/114; 134/201
(58) Field of Search ..... 134/114, 200, 134/201; 49/469, 470; 312/296

(56) References Cited

U.S. PATENT DOCUMENTS 6,006,767 A * 12/1999 Hecker et al. ..... 134/201 X

FOREIGN PATENT DOCUMENTS

| | | | |
|---|---|---|---|
| DE | 7017821 | | 1/1971 |
| DE | 32 42 640 A1 | | 5/1984 |
| DE | 35 41 777 A1 | | 5/1987 |
| DE | 199 07 087 A1 | | 8/2000 |
| GB | 2130082 | * | 5/1984 |
| GB | 2201886 | * | 9/1988 |

* cited by examiner

*Primary Examiner*—Philip Coe
(74) *Attorney, Agent, or Firm*—Laurence A. Greenberg; Werner H. Stemer; Ralph E. Locher

(57) ABSTRACT

The frontloading dishwasher has a dishwashing compartment and a door mounted on the machine body such that it can be pivoted about a horizontal axis for closing a loading opening of the dishwashing compartment. The bottom border of an inner wall of the door, forming a door lip, engages behind a compartment skirt that rises from the dishwashing-compartment base. A seal is arranged between the door and the dishwashing compartment. The seal includes a sealing strip that extends across the entire door width. Satisfactory sealing of the dishwasher is ensured over a long period of use, dirt deposits in the sealing region are avoided, and only a low level of force for moving the door is required in that a guide and securing device for the seal is provided, for securing the seal in the rest position and for guiding the seal during movement of the door.

4 Claims, 1 Drawing Sheet

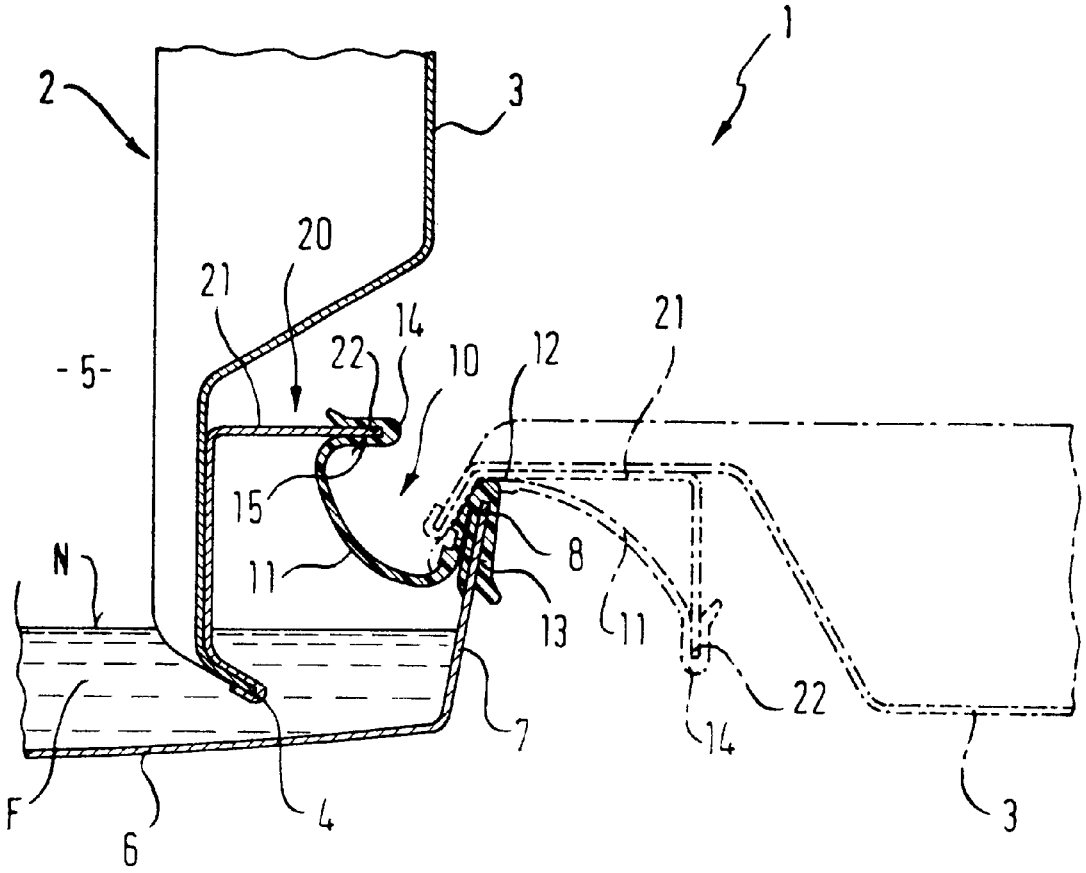
1
2
3
20
21
14
22
10
12
21
- 5-
15
8
N
11
13
11
22
14
7
F
6
4
3

DISHWASHER

CROSS-REFERENCE TO RELATED APPLICATION

This application is a continuation of copending International Application PCT/EP00/06348, filed Jul. 5, 2000, which designated the United States.

BACKGROUND OF THE INVENTION

Field of the Invention

The invention relates to a front-loadable dishwasher having a dishwashing compartment and a door which is mounted on the machine body such that it can be pivoted about a horizontal axis. The pivoting of the door is intended for closing a loading opening of the dishwashing compartment. The inner wall of the door engages by way of its bottom border, forming a door lip, behind a compartment skirt, which is raised up from the dishwashing-compartment base in the region of the bottom edge of the loading opening, and terminates at a distance above the dishwashing-compartment base. A seal is arranged between the door and the dishwashing compartment and is designed as a sealing strip that extends over the entire door width.

German Utility Model 70 22 821 discloses a dishwasher of the type mentioned in the introduction. There, a sealing strip made of an elastomeric material is arranged such that the section of the sealing strip which is located between the sides curves into a cavity between an inner door shell and an outer door shell of the door, which is made up in shell form of an inner door and an outer door. This upwardly extending curvature of the sealing strip forms a type of "intercepting channel" for dirt, which can be flushed out as the dishwashing liquid is circulated. In order for it to be possible to form this upwardly extending curvature of the sealing strip, the sealing strip is fastened, adjacent to the compartment skirt, on the bottom edge of the dishwashing-compartment base and on the door lip. It has been found in practice that the fastening on the dishwashing-compartment base results in leakage through necessary bores and fastening means. It has also been found in practice that the very pronounced definition of the sealing strip during opening and closure of the door gives rise to material fatigue, which results in the elastomeric material breaking and in the risk of the dishwasher leaking and/or of dishwashing liquid passing out of the dishwasher. Moreover, the pronounced deformation of the sealing strip during opening and closure of the door results in a comparatively high level of force being required in order to move the door.

SUMMARY OF THE INVENTION

It is accordingly an object of the invention to provide a dishwasher, which overcomes the above-mentioned disadvantages of the heretofore-known devices and methods of this general type and which assures satisfactory sealing over a long period of use and the avoidance of deposits of dirt in the sealing region as well as the application of only a low level of force for moving the door.

With the foregoing and other objects in view there is provided, in accordance with the invention, a front-loadable dishwasher having a dishwashing compartment and a door pivotally mounted about a substantially horizontal axis for closing a loading opening to the dishwashing compartment. The dishwashing compartment is formed with a dishwashing-compartment base and a compartment skirt that rises from the dishwashing-compartment base to a bottom edge of the loading opening. The door has an inner wall with a bottom border forming a door lip that engages behind the compartment skirt. A sealing device between the door and the dishwashing-compartment comprises a sealing strip extending across an entire width of the door, and a guide and securing device attached to the seal, for securing the seal in a rest position of the door, and for guiding the seal during a movement of the door.

In other words, the objects are achieved in that guide and securing device for the seal secures the seal in the rest position and guides the seal during a movement of the door.

The guide and securing means for the seal are configured, in accordance with the object, such that the seal, in order to avoid deposits of dirt in the sealing region, does not come into direct contact with the dishwashing liquid in the closed position of the door and, in order to ensure satisfactory sealing over a long period of use, is not deformed to a pronounced extent during movement of the door. The low level of deformation of the seal during movement of the door keeps the application of force required for moving the door to a low level. The guide and securing means for the seal are further configured, in accordance with the object, such that they assist the sealing action of the seal, with the result that any additional bores and fastenings of the seal in the sealing region are avoided. The invention provides in a straightforward manner a dishwasher of the type mentioned in the introduction, in the case of which satisfactory sealing over a long period of use and the avoidance of deposits of dirt in the sealing region as well as the application of only a low level of force for moving the door are ensured.

In accordance with an added feature of the invention, the seal is fastened on the inner wall of the door by means of a profile which projects in the direction of the compartment skirt in the closed position and which forms the guide and securing means for the seal. During movement of the door, the profile, which projects in the direction of the compartment skirt in the closed position, carries along the seal arranged on the compartment skirt, with the result that pronounced deformation of the seal cannot take place and the seal is not visible to the user in the open position. The profile, which projects in the direction of the compartment skirt in the closed position, prevents the seal from sagging down as far as the dishwashing liquid. Since the seal is arranged above the dishwashing-liquid level in the closed position, free flushing out of the door lip, of the compartment skirt and of the seal is reliably ensured and discharge of dishwashing liquid, which could pass to the outside when the door is opened, is avoided.

In accordance with an additional feature of the invention, the seal is fitted onto the top termination border of the compartment skirt. Fitting the seal onto the compartment skirt avoids any additional bores and fastening means in the dishwashing-compartment base.

In accordance with a concomitant feature of the invention, the seal is fitted onto the free termination border of the profile. This achieves easier installation.

Other features which are considered as characteristic for the invention are set forth in the appended claims.

Although the invention is illustrated and described herein as embodied in a dishwasher, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWING

The single drawing FIGURE shows a partial section through the sealing region of a dishwasher according to the invention, where a closed position is shown by solid lines and an open position is shown by dahs-dotted lines.

DESCRIPTION OF THE PREFERRED EMBODIMENTS

Referring now to the sole FIGURE of the drawing in detail, a front-loadable or frontloading dishwasher 1 has a dishwashing compartment 5 which is intended for accommodating articles to be cleaned and of which the introduction or access opening is closed by a door 2. The door 2 is mounted on the machine body such that it can be pivoted about a substantially horizontal axis.

In the exemplary embodiment that is shown and described, use is made of a door 2 which, in a manner which will not be described in any more detail, is made up in shell form of an inner door and an outer door. The outer door shell is not shown. The inner wall 3 of the door 2 forms a door lip 4 by way of its bottom border. The door lip 4 engages behind a compartment skirt 7, which is raised up from the dishwashing-compartment base 6 in the region of a bottom edge of the loading opening, and terminates at a distance above the dishwashing-compartment base 6. A seal 10 is arranged between the door 2 and the dishwashing compartment 5. The seal 10 is designed as a sealing strip 11 extending over the entire door width and, in the exemplary embodiment shown, consists of an elastomeric material.

According to the invention, guide and securing means 20 for the seal 10 are provided for securing the seal 10 in the rest position and for guiding the seal 10 during movement of the door 2. In the exemplary embodiment shown, the guide and securing means 20 for the seal 10 is formed by a profile 21 which projects in the direction of the compartment skirt 7 in the closed position. The seal 10 or the sealing strip 11 is fastened on the inner wall 3 of the door 2 by means of said profile 21. The seal 10 of the sealing strip 11 thus extends between the inner wall 3 of the door 2 and the dishwashing compartment 5. The profile 21 is fastened on the door 2 in the manner described for a door strip in the commonly assigned, published German patent application DE 199 07 087 A1, with the result that no fastening means, such as screws, etc., are required in addition.

At the dishwashing compartment 5, the seal 10 or the sealing strip 11 is fitted onto the top termination border 8 of the compartment skirt 7. For this purpose, the side 12 of the sealing strip 11, said side being assigned to the compartment skirt 7, has a groove-like mount 13 which can be installed with prestressing on the top termination border 8 of the compartment skirt 7, i.e. the width of the mount 13 is somewhat smaller than the thickness of the top termination border 8 of the compartment skirt 7.

On the side 14 of the sealing strip 11, the side being assigned to the door 2, the seal 10 is fitted onto the free termination border 22 of the profile 21, this side 14 of the sealing strip 11, the side being assigned to the door 2, having, as it does for fastening on the compartment skirt 7, a groove-like mount 15 which can be installed with prestressing on the free termination border 22 of the profile 21.

During movement, the guide and securing means 20 according to the invention—the profile 21 which projects in the direction of the compartment skirt 7 in the closed position—carries along the seal 10 arranged on the compartment skirt 7. As a result, a pronounced deformation of the seal 10 cannot take place and the seal 10 is not visible to the user in the open position. The low level of deformation of the seal 10 during movement of the door 2 keeps the application of force required for moving the door 2 to a low level. Fitting the seal 10 onto the compartment skirt 7 avoids any additional bores in the dishwashing—compartment base 6. The guide and securing means 20 according to the invention—the profile 21 which projects in the direction of the compartment skirt 7 in the closed position—prevents the seal 10 from sagging down as far as the dishwashing liquid F. Since the seal 10 is arranged above the dishwashing-liquid level N in the closed position of the door 2, free flushing out of the door lip 4, of the compartment skirt 7 and of the seal 10 is reliably ensured and discharge of dishwashing liquid F, which could pass to the outside when the door 2 is opened, is avoided.

The invention provides in a straightforward manner a dishwasher 1 of the type mentioned in the introduction, in the case of which satisfactory sealing over a long period of use and the avoidance of deposits of dirt in the sealing region as well as the application of only a low level of force for moving the door 2 are ensured.

We claim:

1. In a front-loadable dishwasher having a dishwashing compartment and a door pivotally mounted about a substantially horizontal axis for closing a loading opening to the dishwashing compartment, the dishwashing compartment being formed with a dishwashing-compartment base and a compartment skirt rising from the dishwashing-compartment base to a bottom edge of the loading opening, the door having an inner wall with a bottom border forming a door lip and engaging behind the compartment skirt, a sealing device, comprising:

a seal disposed between the door and the dishwashing-compartment, said seal including a sealing strip extending across an entire width of the door, and a guide and securing device attached to said seal, for securing said seal in a rest position of the door, and for guiding said seal during a movement of the door.

2. The dishwasher according to claim 1, wherein said guide and securing device for said seal comprises a profile fastening said seal on the inner wall of the door, said profile projecting towards the compartment skirt in the closed position.

3. The dishwasher according to claim 2, wherein said seal is fitted onto a free termination border of said profile.

4. The dishwasher according to claim 1, wherein said compartment skirt is formed with an upper termination border and said seal is fitted onto the upper termination border of the compartment skirt.

* * * * *